US005775674A

United States Patent [19]

Bigham

[11] Patent Number: 5,775,674

[45] Date of Patent: Jul. 7, 1998

[54] LIFT APPARATUS HAVING A PIVOTING POLE FOR LIFTING AND MOVING A MANHOLE COVER

[76] Inventor: Vern Bigham, 354 Forest La., North Mankato, Minn. 56003

[21] Appl. No.: 731,316

[22] Filed: Oct. 15, 1996

[51] Int. Cl.[6] ..... B66F 3/00

[52] U.S. Cl. ..... 254/131; 254/133; 254/134; 254/130; 294/17; 74/544

[58] Field of Search ..... 254/131, 133 R, 254/134, DIG. 1, 129, 130, DIG. 3; 294/17, 26; 16/115; 74/544

[56] References Cited

U.S. PATENT DOCUMENTS

| | | | |
|---|---|---|---|
| 1,427,576 | 9/1922 | Bryant | 254/132 |
| 3,985,338 | 10/1976 | Herrmann | 254/131 |
| 4,157,810 | 6/1979 | Haller et al. | 254/131 |
| 4,250,769 | 2/1981 | Herring | 254/129 |
| 4,365,786 | 12/1982 | Osteen | 254/129 |
| 4,695,037 | 9/1987 | Hadbavny | 254/131 |
| 4,793,646 | 12/1988 | Michaud, Jr. | 16/115 |
| 4,991,893 | 2/1991 | Gordon et al. | 254/131 |
| 5,165,661 | 11/1992 | Wright | 254/131 |

FOREIGN PATENT DOCUMENTS

| | | | |
|---|---|---|---|
| 273887 | 7/1927 | United Kingdom | 254/131 |

*Primary Examiner*—James G. Smith
*Assistant Examiner*—Lee Wilson
*Attorney, Agent, or Firm*—Merchant, Gould, Smith, Edell, Welter & Schmidt, P.A.

[57] ABSTRACT

A lift device for lifting a manhole cover which includes a base and a pole configured to lift the manhole cover when one end of the pole is pressed downward. The length of the pole is adjustable in order to permit easy storage and transportation, and to increase the lift force. Retainers are configured to secure manhole covers to the lift device to permit the lifting of the manhole covers in a manner that their center of mass is kept near the end of the pole.

9 Claims, 10 Drawing Sheets

LIFT APPARATUS HAVING A PIVOTING POLE FOR LIFTING AND MOVING A MANHOLE COVER

TECHNICAL FIELD

The present invention relates to a lift apparatus and method for lifting a manhole cover. More particularly, the present invention relates to a manually operated lift device and method for lifting a manhole cover with one or more of a plurality of manhole retainers.

BACKGROUND

Utility covers, also known as "manhole" covers, are frequently used to cap entrances to subsurface enclosures. For example, manhole covers are often used to cover the openings to sanitary and storm sewers, subsurface telephone cable and communication line junction boxes, electrical enclosures, and enclosures providing access to subterranean pipes.

Most manhole covers are constructed of thick metal, commonly iron, and are often very heavy—usually weighing over 50 pounds. The great strength and weight of manhole covers serve a number of purposes, including preventing unauthorized access to the enclosure by children or other persons, preventing inadvertent movement and displacement of the manhole cover by vehicles, and providing a solid base for people and transportation equipment traveling over the manhole.

However, the weight of manhole covers also poses a significant problem to their use because they are difficult and sometimes hazardous to remove. The fact that manhole covers are usually heavy, combined with the fact that they are usually positioned at ground level, means that a worker trying to remove a manhole cover usually attempts to lift the heavy manhole cover from a bent-over position. This bent-over lifting position can lead to back injuries, which result in pain and suffering. These injuries also cause lost productivity and income for employees and employers.

A conventional method of removing manhole covers is to pry the edge of the manhole cover upward with a pick, and then rotate the cover away from the opening with either the pick or another tool, such as a shovel or pry-bar. Conventional removal methods often require that the worker removing the cover grab the edge of the cover. Grabbing with hands can be very hazardous, because it risks crushing fingers under the weight of the cover or severely pinching the fingers between the cover and the rim of the manhole. Also, use of the hands usually means that the worker is bent over the manhole, providing additional concern about back injury.

Conventional apparatuses and methods of opening manholes also pose the problem that the worker must be relatively close to the manhole while opening it. This can be problematic because manholes are often very deep, and falling into an open manhole can cause severe injuries or even death. Under some circumstances, such as overflowing sewers or ruptured water mains, water may be leaking out of the top of the manhole, creating a slippery, wet surface proximate the manhole opening. This slippery surface can be especially troubling during winter when ice forms proximate the manhole. Therefore, it is desirable for a manhole opener to permit the removal of the manhole cover while the person is at a safe distance from the opening.

A further problem associated with removing manhole covers is that not all manhole covers can be removed in the same manner. Some covers have a small round opening in the middle of the cover. Other manhole covers have a slot or depression on the outer edge of the cover, while still others have one or more slots, holes, or depressions positioned between the edge and the center of the manhole. These various configurations can be a challenge to open, and may require specialized tools for each manhole.

Another problem associated with removing manhole covers is the difficulty in replacing the manhole cover. Under a conventional method, a pick is used to pry up the edge of the cover, which is then manually flipped up onto its side, rolled over to the opening, and then slowly rotated into place. This is a tedious and somewhat difficult task because of the great weight of the cover. Also, two people are often required to easily replace the manhole cover—the first to pry the edge off the ground, and the second to flip the manhole cover into a vertical position and roll it into place.

Accordingly, there is a need for an apparatus and method for safely, easily, and efficiently removing and replacing a manhole cover. Even further, there is a need for an apparatus which permits one person to remove and replace a manhole cover with a minimum of stress and danger, and a reduced risk of injuries to hands, feet, and backs.

SUMMARY

In accordance with the present invention, an apparatus and method is provided for lifting a manhole cover. The apparatus includes a base and a pole. The pole has a first end, a second end, and an intermediate portion. The intermediate portion is pivotally connected to the base. The first end is configured to receive a retainer for attaching to a manhole, and the second end is configured to receive a downward force from a hand. In addition, the pole is adjustable so that the distance between the pivot point and the second end may be selectively changed.

The present invention also provides a method for removing a moldable cover. The method uses a lift device comprising a base, a pole having a first end configured to receive a retainer for attaching to a manhole cover, a second end, and an intermediate portion pivotally connected to the base. The method includes the steps of adjusting the length of the second end, operably connecting the lift device to a manhole cover, applying a downward pressure to the second end so that the first end is moved upward and the manhole cover is lifted, and pivoting the manhole cover to a side of the manhole to permit entry into the manhole by a person.

DETAILED DESCRIPTION

Figure 1:
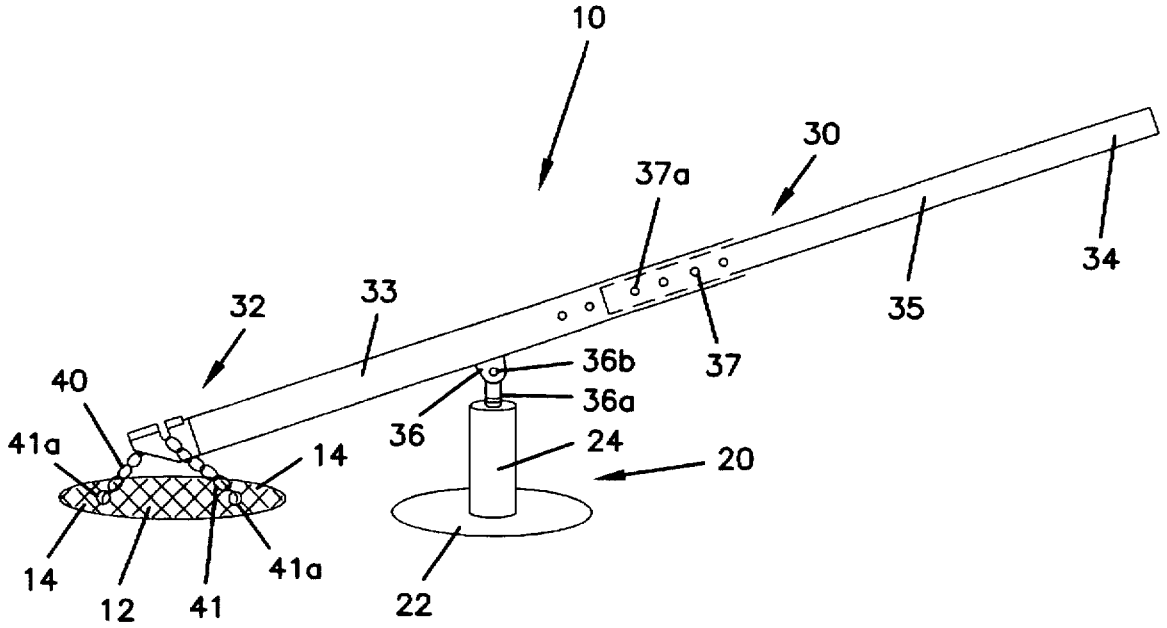
FIG. 1 is an elevated perspective view of a first embodiment of the present invention, showing the lift apparatus secured to a manhole cover before removal of the cover.

The present invention initially will be described in general terms. Various embodiments of the present invention, including a preferred embodiment, then will be described in detail with reference to the drawings wherein like reference numerals represent like parts and assemblies throughout the several views. Reference to the described embodiments does not limit the scope of the invention, which is limited only by the scope of the appended claims.

The present invention is generally directed to a device for lifting manhole covers. The invention generally comprises a lever device that can pivot up and down, and swing from side to side. The pivoting device also has several special attachments for gripping the manhole cover. The lifting device can be made from a lightweight material and can be collapsed for easy storage and carrying. Additionally, the handle can extend or retract in order to adjust the amount of leverage which is required in order to lift the manhole cover.

The invention has many advantages. For instance, a worker can simply lift and pivot a manhole cover with a single arm. The use of leverage eliminates the need for workers to bend over or otherwise strain their backs. As a result, back injuries are minimized, which also eliminates painful physical conditions, time lost from work, and workers' compensation claims. Another advantage of the present invention is that it can use different attachment devices for gripping the manhole cover. As a result, the present invention has a great deal of versatility and can be used with any type of manhole cover that is manufactured.

Referring now to the figures, in FIG. 1, lift apparatus 10 includes a base 20, and a pole 30. The pole 30 is connected to the base 20 at a pivot 36. The pivot 36 permits the pole 30 to be rotated on two axes so that it may pivot up and down as well as left and right.

A first end 32 of the pole 30 is configured to receive a retainer 40 for securing to the manhole cover 12. The manhole cover 12 may be a solid round cover. Alternatively, the manhole cover 12 may be a perforated grate positioned over a storm or sanitary sewer, or other heavy ground-level cover for over a subsurface space. A second end 34 of the lift apparatus 10 is configured for receiving a downward force from a hand. The length of the pole 30, measured as the distance between the first end 32 and the second end 34 is adjustable so that the pole 30 can be extended to increase the leverage applied in lifting a manhole cover 12 or to shorten the pole 30 to make transport and carrying more convenient.

Figure 2:
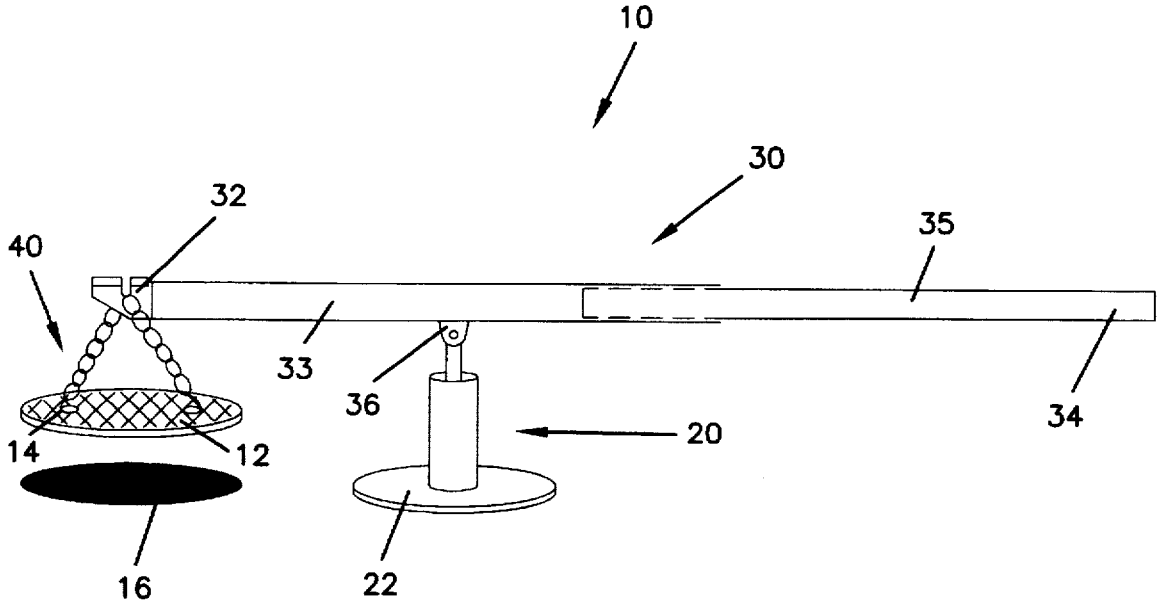
FIG. 2 is an elevated perspective view of a first embodiment of the present invention, showing the manhole cover immediately after removal from the manhole opening.
Figure 3:
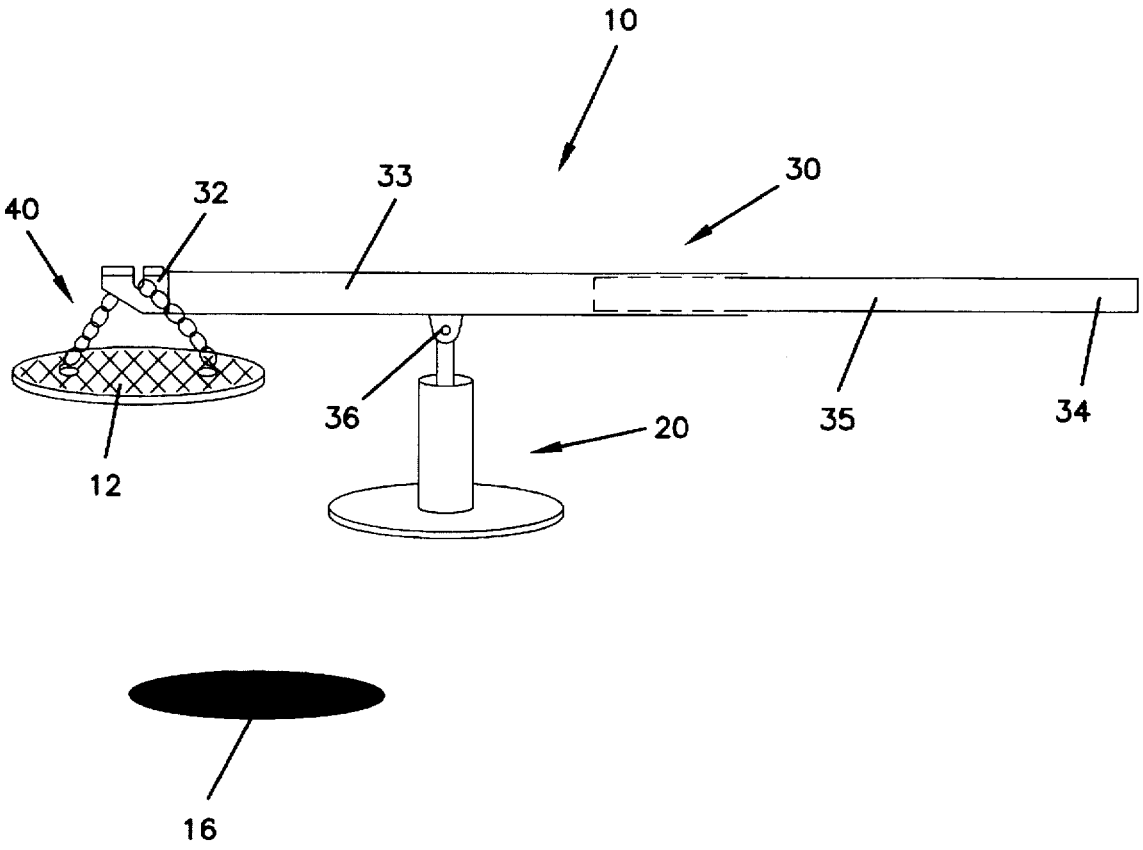
FIG. 3 is an elevated perspective view of a first embodiment of the present invention, showing the manhole cover rotated to the side of the manhole opening.

Referring now to FIGS. 1–3, the lift apparatus 10 is utilized by positioning the base 20 at a distance such that the first end 32 is proximate the manhole cover 12. The pole 30 is extended to an appropriate length to increase the leverage when a downward force is applied to the second end 34. A suitable retainer 40 is secured to the first end 12 of the pole 30 and to an opening or openings 14 in the manhole cover 12. Once the retainer 40 is secured to the first end 32 at opening or openings 14, a downward force may be applied to the second end 34 of the pole 30. This downward force must be sufficient to lift the manhole cover 12 from the manhole opening 16, as shown in FIG. 2.

The distance between the first end 32 and the pivot 36 is less than the distance between the second end 34 and the pivot 36, thereby increasing the leverage and requiring a downward force on the second end 34 less than the weight of the manhole cover 12. Under some circumstances, it may be necessary to initially apply a greater force to lift the manhole cover 12 if the cover 12 is stuck to the manhole opening 16. Such sticking can occur, for example, because of seal coating which has entered the crack between the manhole cover 12 and manhole opening 16, or because of the buildup of rust or grit. As a result, the worker may need to first loosen the manhole cover 12 by striking it with a heavy object, such as a sledgehammer or pick.

As shown in FIG. 3, once the manhole cover 12 has been lifted from the manhole opening 16 by the lift apparatus 10, it is pivoted to one side or the other of the manhole opening 16. A downward force to the second end 34 still must be applied while the manhole cover 12 is pivoted to the side of the manhole opening 16. Once the manhole cover 12 has been pivoted a satisfactory distance away from the manhole opening 16, the downward force on the second end 34 of the pole 30 may be gradually reduced so as to set down the manhole cover 12.

Once the manhole cover 12 has been removed, access to the open manhole is possible, and entry into the manhole opening 16 is possible for performing any necessary tasks. In order to return the manhole cover 12 to the manhole opening 16, the opposite steps are undertaken. First, the manhole cover 12 is lifted from its position proximate the opening 16 by application of a downward force to the second end 34. A horizontal force is then applied to the second end 34 in order to pivot the pole 30 and manhole cover 12 back into position over the opening 16. When the manhole cover 12 is properly aligned over the top of the manhole opening 16, the downward pressure on the second end 34 is reduced and the cover 12 is allowed to rest back over the opening 16.

During the removal and replacement of the manhole cover 12, it is advantageous that the base 20 remain in one location so that minimal adjustment of the position of the cover 12 is necessary on replacement of the cover 12. Alternatively, the position of the base 20 can be marked with chalk or other marking medium to temporarily record the preferred location of the base 20. In this alternative method, the lift apparatus 10 can be moved to another location after removal of the first manhole cover 12. This method of marking the location of the base 20 is particularly useful when multiple manhole covers 12 must be opened at one time but only one lift apparatus 10 is available. However, even if the position of the base 20 is not marked, the lift apparatus 10 is still easy to use because the proper approximate location will be readily apparent upon visual observation.

The pole 30 is expandable. The pole 30 contains a first portion 33 including a first end 32, and connected to the pivot 36. The pole 30 further contains a second portion 35 including a second end 34. The first portion 33 is arranged so that the second portion 35 may telescope into the first portion 33. The first portion 33 is preferably constructed of a hollow round aluminum tube having an interior diameter slightly greater than the exterior diameter of an aluminum tube forming the second portion 35. However, other embodiments are contemplated, including the use of a square or rectangular tube for the first portion 33 and second portion 35. Other forms of interlocking sliding rails are also contemplated.

The two portions 33 and 35 of the pole 30 slide back and forth in order to adjust the length of the pole 30. As shown in FIG. 1, stops 37 may be placed in the pole in order to temporarily lock the pole 30 at a specific length. The locks 37 may be constructed by forming aligning holes 37*a* in the sides of the first portion 33 and second portion 35. A pin or other fastener may be inserted through the holes 37*a* in order to restrict sliding of the second portion 35 with respect to the first portion 33.

Figure 4:
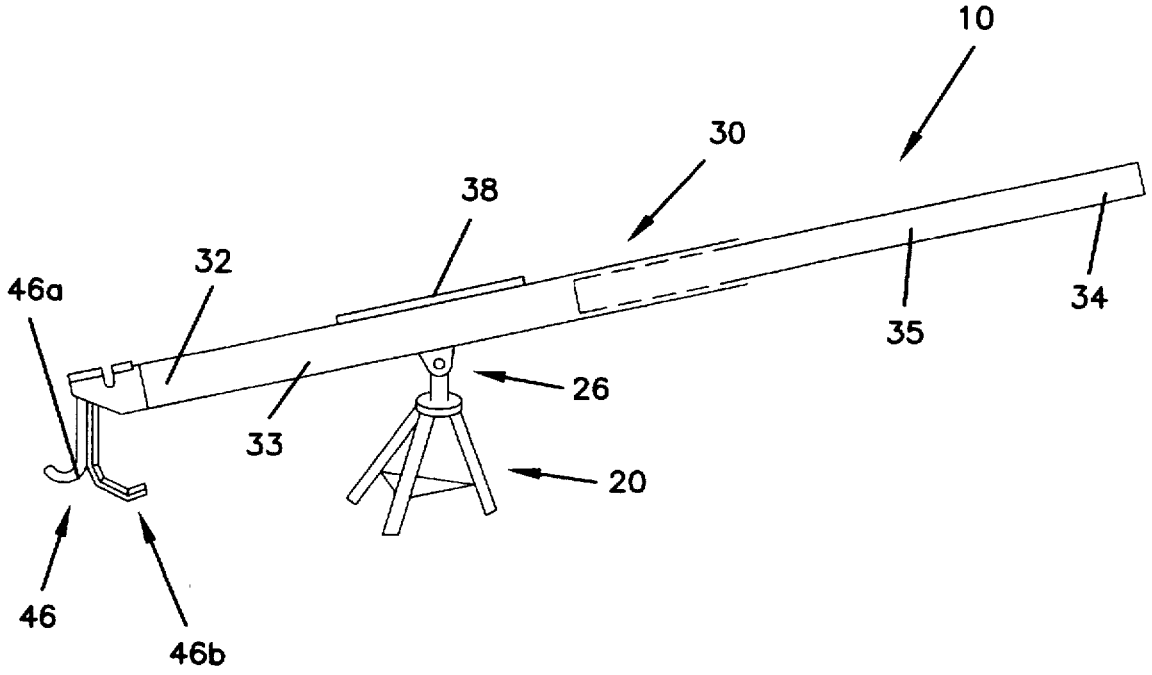
FIG. 4 is an elevated perspective view of a second embodiment of the present invention, showing the lift apparatus with a tripod base.

Referring now to FIG. 4, the pole 30 may be formed of a number of materials having suitable qualities of bearing heavy loads. Metals are preferred, with aluminum and aluminum alloys most preferred. Other materials, including steel and other ferrous metals, as well as fiberglass or other composite materials, can also be used. In order to increase the strength of the pole 30, a reinforcing member 38 may be secured or integrally formed within the portion of the pole 30 proximate the pivot 36.

The length of the pole 30 will vary depending upon the expected use and travel requirements. For portable lift apparatus 10, one possible configuration for the pole 30 has a contracted length which is less than nine feet so that the lift apparatus 10 may fit within the bed of a pickup truck.

In order to enhance the leverage advantage associated with the lift apparatus 10, the length of the pole 30 from the second end 34 to the pivot 36 should be significantly longer then the length of the pole 30 from the first end 32 to the pivot 36. In one possible configuration, the length from the second end 34 to the pivot 36 is at least twice the length from the first end 32 to the pivot 36.

The extendible nature of the pole 30 makes it possible for a person to lift a heavier manhole cover 12 than would be possible without an extendible pole 30. In one embodiment, the pole 30 may be extended from approximately 8 feet to approximately 14 feet, in which case the effective lifting force is substantially increased, while the traveling length is not.

The shortening of the pole 30 also permits the lift apparatus 10 to be used in locations where space does not permit a fully extended pole 30 to be used. While it is true that most manhole covers are located in relatively open places such as roadbeds and sidewalks, some situations may arise where a full-length lift apparatus 10 will not be suitable. Although some shortening of the pole 30 will result in decreasing the leverage applied to lifting the manhole cover 12, the shortened pole 30 still will be advantageous.

The pivot 36 may be a threaded shaft 36*a* screwed into the upright portion 24. This threaded shaft 36*a* permits the pole 30 to rotate clockwise and counterclockwise with respect to the base 22. In addition, a joint or hinge 36*b* permits the pole 30 to rotate up and down.

Figure 5A:
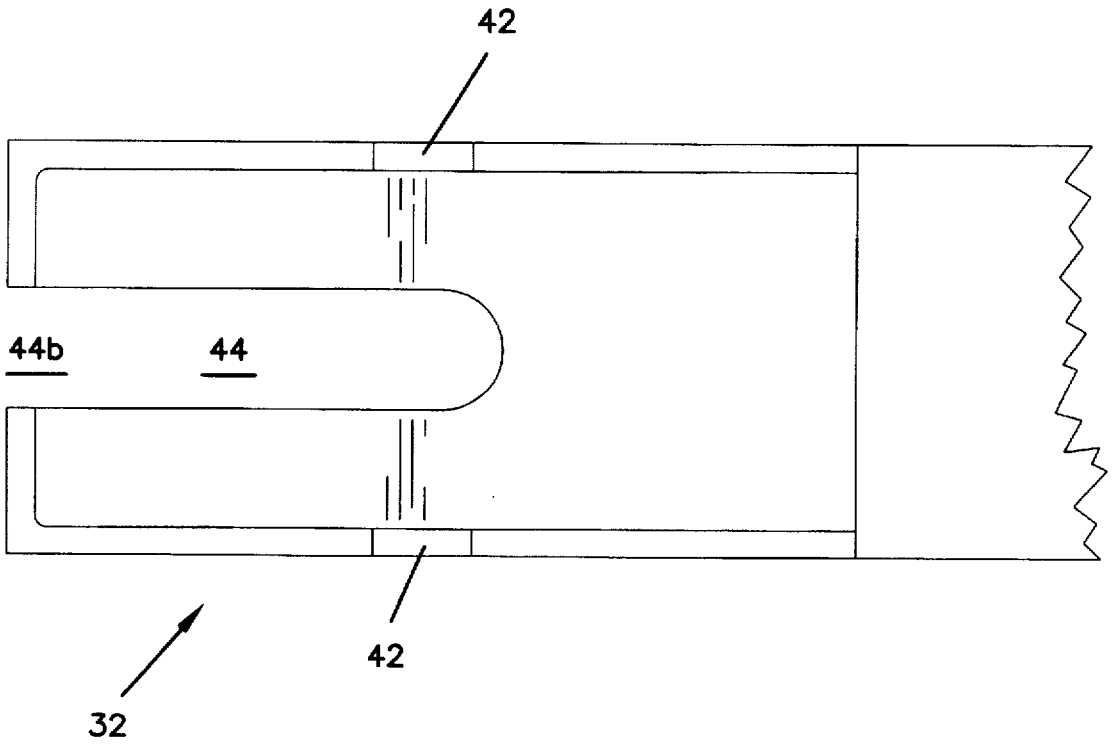
FIG. 5A is a partial top view of the first end of the present invention.
Figure 5B:
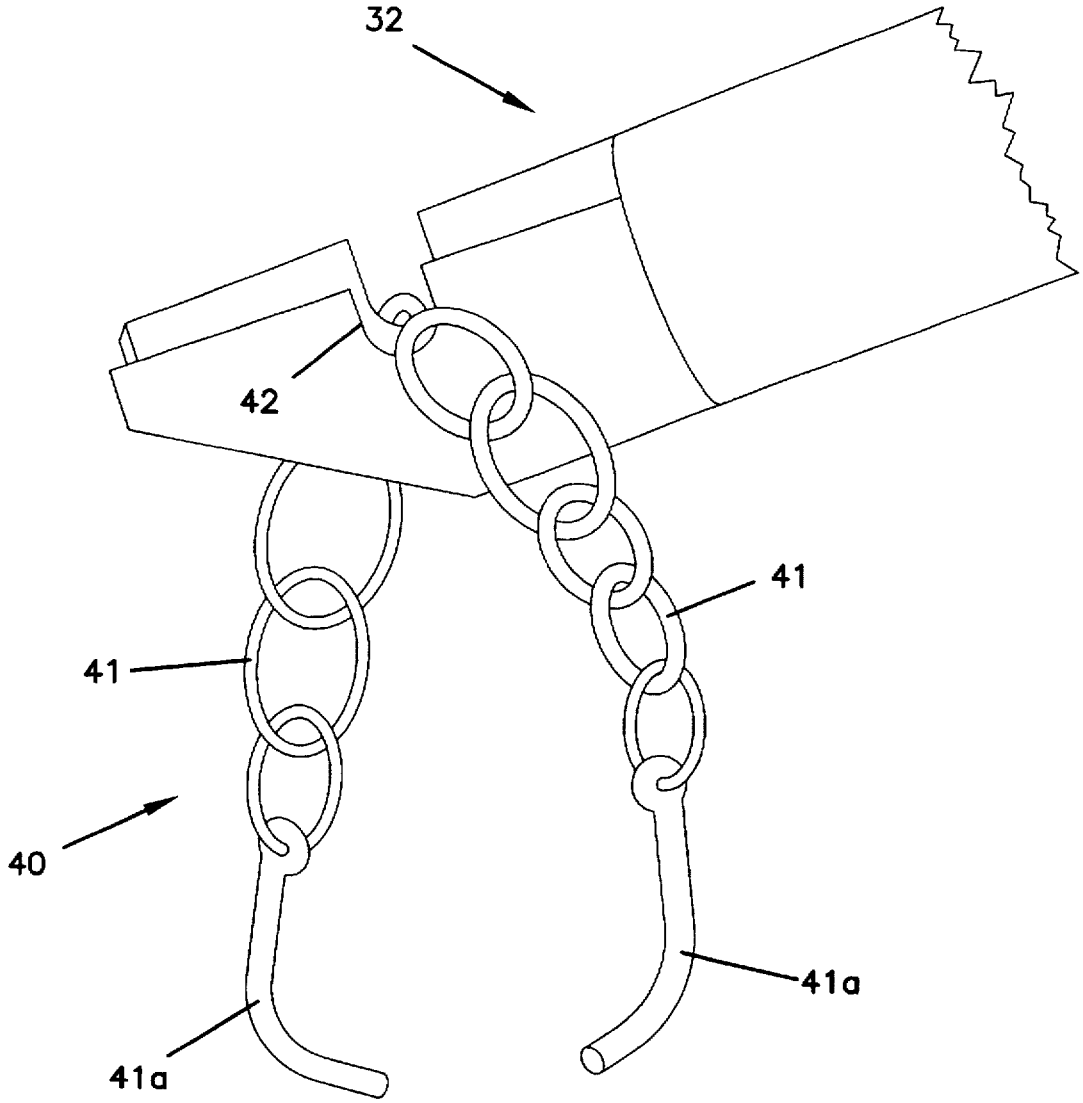
FIG. 5B is a partial perspective view of an embodiment of the first end and a retainer of the present invention, the retainer configured to lift a manhole cover with two hooks connected to a chain.

Referring now to FIGS. 5A, 5B, 5C, and 5D, the first end 32 of the pole 30 is versatile and is configured to receive a variety of different kinds of manhole cover retainers 40. The first end 32 includes a transverse opening or openings 42 for connecting a retainer 40 around the end of the first end 32. In one possible configuration, the transverse openings 42 are slots. As shown in FIG. 5B, the transverse opening 42 permits a retainer 40 comprising a chain 41 with hooks 41*a* connected to the end of the chain 41. The hooks 41*a* are secured to the manhole cover 12 by hooking into openings 14 in the manhole cover 12. Referring to FIG. 5A, the first end 32 further includes a medial opening 44 positioned for securing an alternative retainer 40 to the first end 32. The medial opening 44 comprises a slot into which a bolt may be inserted to secure the retainer 40 to the first end 32. The slot may either be open at the end 44*b*, as shown in FIG. 5A, or closed at the end.

Different retainers 40 are used with the lift apparatus 10 depending upon the type of manhole cover 12. Some manhole covers 12 have a central opening piercing all the way through the manhole cover 12, while others have a plurality of openings piercing the manhole cover 12 at two or more positions. Another common manhole cover configuration is one in which one or more depressions penetrate part-way into the manhole cover 12, but do not penetrate all the way through. Instead, such configurations typically include either a rod extending across the depression, or the depression penetrates horizontally into the manhole cover 12 in order to create a small lip. In some of these partially penetrating configurations, only one off-center opening is present.

Figure 5C:
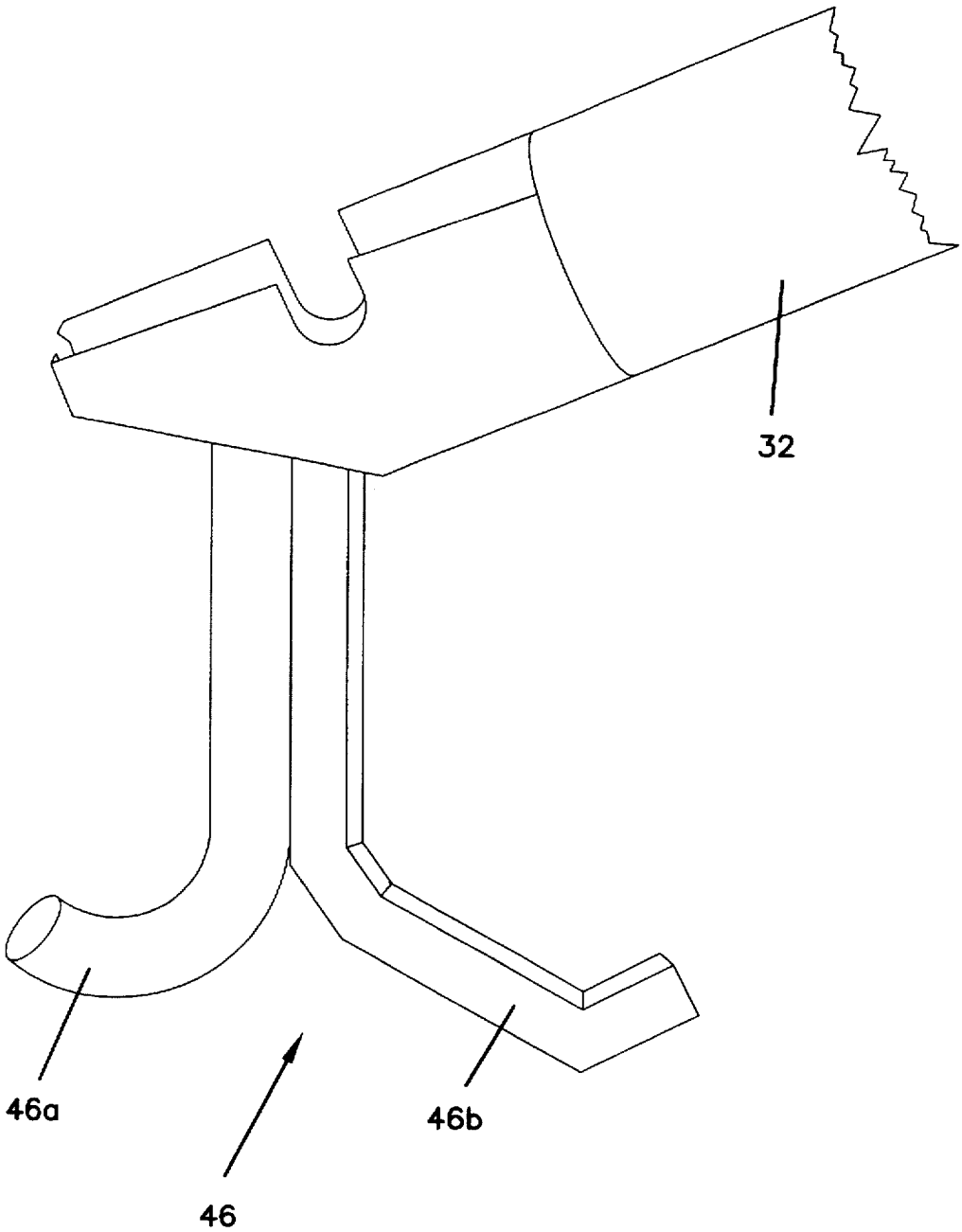
FIG. 5C is a partial perspective view of an embodiment of the first end and retainer of the present invention, the retainer configured to lift a manhole cover with either a circular or rectangular hook.

A double-hook retainer 46 for inserting into a plurality of different configurations of holes in the manhole cover 12 is shown in FIGS. 4 and 5C. The double-hook retainer 46 includes a first hook-shaped end 46*a* having a generally circular cross-section for inserting into a generally circular opening of a manhole cover 12. Retainer 46 further includes a hook 46*b* having at least one substantially flat surface for insertion into an opening also having at least one substantially flat surface. An example of a manhole cover having a substantially flat surface includes manhole covers that have a depression which penetrates horizontally into the manhole cover 12, as described above. In a preferred embodiment, hook 46*b* is formed with a substantially rectangular cross-section so that it may fit into a substantially rectangular opening in a manhole cover 12.

Figure 5D:
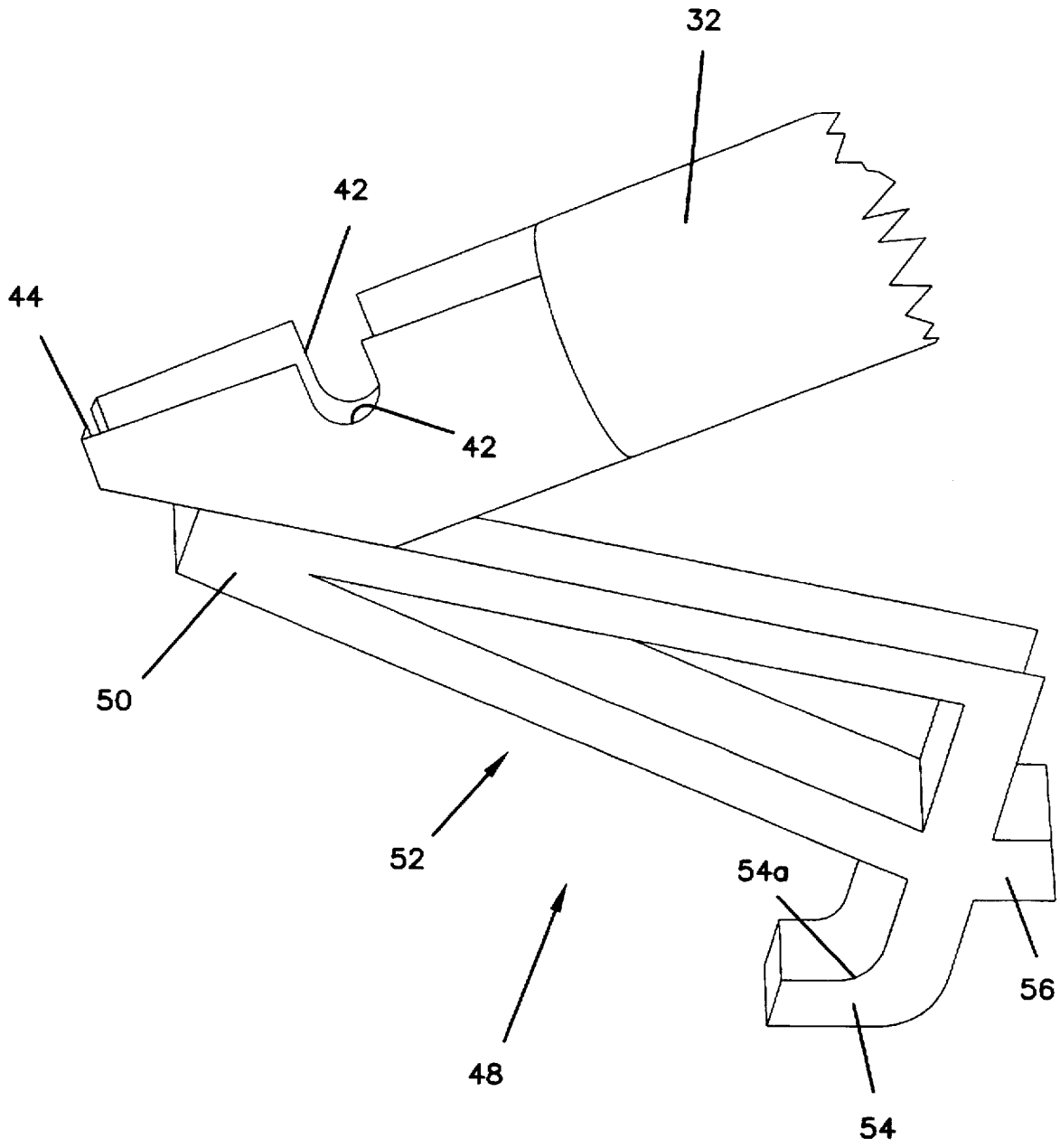
FIG. 5D is a partial perspective view of an embodiment of the first end and a retainer of the present invention, the retainer configured to lift a manhole cover at an off-center opening in the cover.
Figure 6:
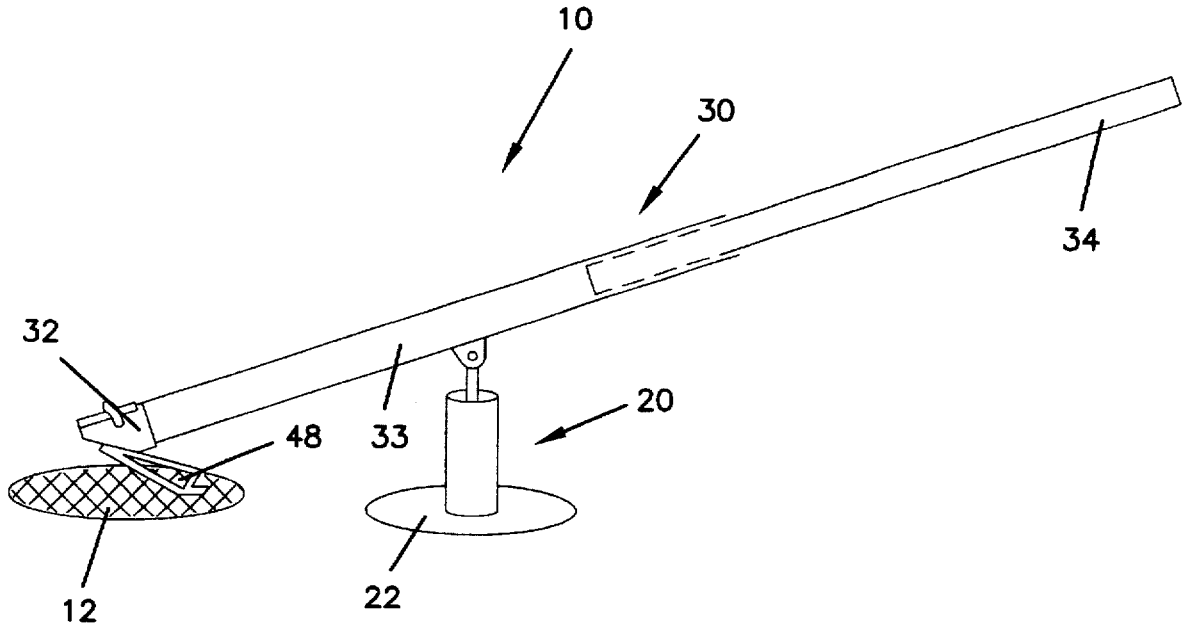
FIG. 6 is an elevated perspective view of the embodiment shown in FIG. 5, secured to a manhole cover.

A further embodiment of retainer 40 is depicted in FIGS. 5D and 6, and shown generally as extension arm retainer 48. Extension arm retainer 48 includes a head 50, an arm 52, and a foot 54. The head 50 is removably attachable to the first end 32 by a bolt or other means, preferably into slot 44. The arm extends backwards toward the base 20, and terminates in a foot 54. The foot 54 is configured with a hook 54*a* configured to slide into an off-center depression in a manhole cover 12.

In a preferred embodiment of extension arm retainer 48, the arm 52 is of sufficient length so that when hook 54 is inserted into an off-center hole in a manhole cover 12, the first end 32 and head 50 are positioned substantially above the center of mass of the manhole cover 12. The positioning of the first end 32 over the center of mass of the manhole cover 12 reduces the tendency for the manhole cover 12 to rotate and tip, thereby making the cover 12 easier to handle by the apparatus 10.

In order to increase the strength of retainer 48, a heel 56 may be positioned at the base of the foot 54. Heel 56 provides a counterbalancing force to stabilize and balance the manhole cover 12 on the foot 54. The heel may be an extended portion of the foot 54, and is preferably wider than the foot 54 to provide increased protection from angular rotation.

Figure 7:
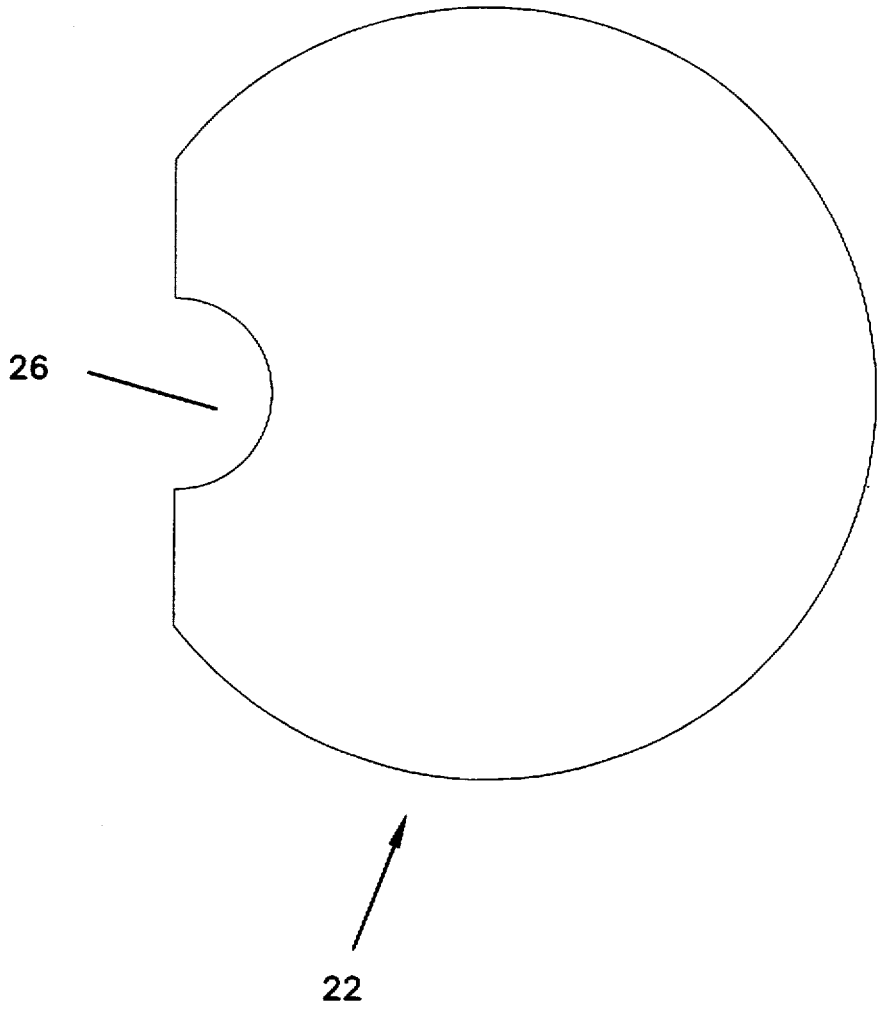
FIG. 7 is a top elevation view of a base of the present invention.

The base 20 provides a stable platform for lifting a manhole cover 12. The base 20 is preferably a generally flat portion 22 connected to an upright portion 24. The upright portion 24 is secured to the pivot 36. As shown in FIG. 7, the flat portion 22 may include a recess 26 for receiving the pole 30 when storing or transporting the lift apparatus 10. Alternatively, a collapsible or non-collapsible tripod 28 may be used as a base.

While the invention has been described in conjunction with a specific embodiment thereof, it is evident that different alternatives, modifications, and variations will be apparent to those skilled in the art in view of the foregoing description. Accordingly, the invention is not limited to these embodiments or the use of elements having specific configurations and shapes as presented herein. Rather, the scope and spirit of the present invention is dictated by the following claims.

The invention that I claim is:

1. A lift device for lifting a manhole cover, the lift device comprising:

a base having three substantially equal-length legs, each leg including a joint proximate an upper portion of each leg such that the base may be collapsed when not in use by folding the three legs together such that the legs are substantially parallel to one another, and the base may be opened by unfolding each of the legs;

a substantially rigid pole having a first end, a second end, and an intermediate portion, a) the first end including a transverse opening comprising a groove in the first end, the groove extending across an axis formed from the first end to the second end of the pole;

b) the first end further including a medial opening comprising a groove extending from a tip of the first end along an axis formed from the first end to the second end of the pole;

b) the second end including a handle configured for holding by a hand and configured for application of a downward force;

c) the intermediate portion being pivotally connected to the base by means of a threaded shaft projecting into the base such that the pole may pivot horizontally by turning the threaded shaft within the base, and such that pole may be removed from the base by rotating the pole with relation to the base; and a manhole retainer for attaching to a manhole, the manhole retainer comprising a rigid body having a head, a foot, an inflexible body, and a heel; the retainer configured to be rigidly secured in the medial opening of the first end of the pole;

a) the head configured to be rigidly secured to the first end of the pole;

b) the foot rigidly connected to the head by the inflexible body, c) the inflexible body being at least 6 inches in length and formed such that when the head is positioned above a center of mass of the manhole cover prior to removal of the manhole cover, the foot is positioned at a hole in the manhole cover, the hole being distant from the center of mass; and d) the heel positioned opposite the foot, the heel configured and arranged to provide a balancing force during lifting of the manhole cover.

2. The lift device of claim 1, wherein the pole comprises a telescoping portion between the first and second ends for adjusting the distance between the pivot point and the second end.

3. The lift device of claim 1, wherein the pole telescopes from a shortened state for storage and transport, and a lengthened state for use during movement of manhole covers, and the total length of the pole in a shortened state is less than nine feet.

4. The lift device of claim 1, further including a manhole retainer comprising a chain with a plurality of hooks operably connected to the chain.

5. A lift device for lifting a manhole cover, the lift device comprising:

a base having a single substantially circular portion configured to support the lift device on the ground, the circular portion having a notch removed from its perimeter, the notch configured to receive a pole when the lift device is in a non-use state;

a substantially rigid pole having a first end, a second end, and an intermediate portion, a) the first end including a transverse opening comprising a groove in the first end, the groove extending across an axis formed from the first end to the second end of the pole, the groove configured and arranged to receive a chain;

b) the first end further including a medial opening comprising a groove extending from a tip of the first end along the axis formed from the first end to the second end of the pole;

b) the second end including a handle configured for holding by a hand and configured for application of a downward force;

c) the intermediate portion being pivotally connected to the base by means of a threaded shaft projecting into the base such that the pole may pivot horizontally by turning the threaded shaft within the base, and such that pole may be removed from the base by rotating the pole with relation to the base; and a manhole retainer for attaching to a manhole, the manhole retainer comprising a rigid body having a head, a foot, an inflexible body, and a heel; the retainer configured to be rigidly secured in the medial opening of the first end of the pole;

a) the head configured to be rigidly secured to the first end of the pole by engaging the medial opening of the first end;

b) the foot rigidly connected to the head by the inflexible body, such that the foot is not able to move with relation to the head, and oriented with a manhole-engaging end facing toward the head;

c) the body comprising a triangular metal structure having an apex and a base, with the foot secured proximate the base and the head secured proximate the apex of the triangle, the head further configured such that when the head is positioned above a center of mass of the manhole cover prior to removal of the manhole cover, the foot is positioned at a hole in the manhole cover, the hole being distant from the center of mass; and d) the heel positioned opposite the foot, the heel configured and arranged to provide a balancing force during lifting of the manhole cover.

6. The lift device of claim 5, wherein the total length of the pole in a shortened state is less than nine feet.

7. The lift device of claim 5, wherein the pole comprises a telescoping portion between the first and second ends for adjusting the distance between the pivot point and the second end.

8. The lift device of claim 5, wherein the pole telescopes from a shortened state for storage and transport, and a lengthened state for use during movement of manhole covers, and the total length of the pole in a shortened state is less than nine feet.

9. The lift device of claim 5, wherein the first end of the pole further includes a portion for securing a chain and a portion for securing a pin.

* * * * *